United States Patent [19]

Kamijo

[11] Patent Number: 5,152,616

[45] Date of Patent: Oct. 6, 1992

[54] MINIATURE PRINTER

[75] Inventor: Masahiro Kamijo, Suwa, Japan

[73] Assignee: Seiko Epson Corporation, Tokyo, Japan

[21] Appl. No.: 655,867

[22] Filed: Feb. 14, 1991

[30] Foreign Application Priority Data

Feb. 15, 1990 [JP] Japan ..... 2-34743

[51] Int. Cl.[5] ..... B41J 3/54

[52] U.S. Cl. ..... 400/82; 400/145.2; 400/146; 400/174; 101/93.09

[58] Field of Search ..... 400/82, 141.1, 145.2, 400/146, 154.1, 151, 151.1, 279, 299, 304, 306, 463, 466, 649, 174, 175, 904; 101/93.09, 93.18, 93.20, 93.21, 93.22

[56] References Cited

U.S. PATENT DOCUMENTS

| | | | |
|---|---|---|---|
| 2,541,840 | 2/1951 | Stinson | 400/23 |
| 3,220,343 | 11/1965 | Wasserman | 101/93.09 |
| 3,904,015 | 9/1975 | Boyden et al. | 400/145.2 |
| 4,475,828 | 9/1984 | Nishikawa | 400/174 |
| 4,534,665 | 8/1985 | Mori et al. | 400/145.2 |
| 4,560,294 | 12/1985 | Sugawara | 400/146 |
| 4,723,855 | 2/1988 | Mikoshiba et al. | 400/154.5 |
| 4,856,922 | 8/1989 | Berruti | 400/145.2 |
| 4,948,273 | 8/1990 | Tezuka et al. | 400/145.2 |
| 4,994,885 | 1/1995 | Watanabe et al. | 400/145.2 |

FOREIGN PATENT DOCUMENTS

| | | | |
|---|---|---|---|
| 0044523 | 4/1977 | Japan | 400/146 |
| 56-137984 | 10/1981 | Japan . | |
| 57-100089 | 6/1982 | Japan . | |
| 0095147 | 6/1984 | Japan | 400/146 |
| 0132350 | 6/1986 | Japan | 400/146 |
| 0209161 | 9/1986 | Japan | 400/174 |
| 0209162 | 9/1986 | Japan | 400/174 |
| 2048782 | 12/1980 | United Kingdom | 101/93.09 |

OTHER PUBLICATIONS

Patent Abstracts of Japan, vol. 11, No. 54 (M-563) (2501), Feb. 19, 1987 and JP-A-61217271 (Alps Electric Co.), Sep. 26, 1986.

Patent Abstracts of Japan, vol. 4, No. 68 (M-12) (550), May 21, 1980 and JP-A-5532601 (Fujitsu K.K.), Mar. 7, 1980.

*Primary Examiner*—Eugene H. Eickholt

*Attorney, Agent, or Firm*—Blum Kaplan

[57] ABSTRACT

A miniature printer is provided which can print characters in additional different character sets of fonts by combining several character sets which are included in the printer on a type drum or type belt. The printer includes a mechanism for selecting particular character sets and impacting a selected character from a selected character set on a printing medium. After a character is printed, the user may select a character from another character set which is present on the drum or belt and overprints the first character. This combination of character sets allows the printer to produce characters which distinguishable fonts without utilizing different color inks.

41 Claims, 13 Drawing Sheets

FIG. 14(a)
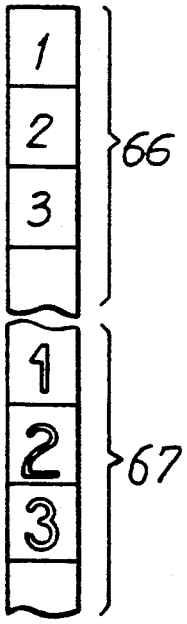
FIG. 14(b)
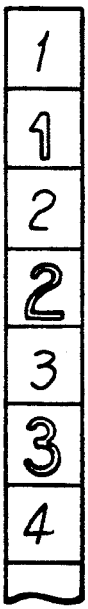
FIG. 18(a)
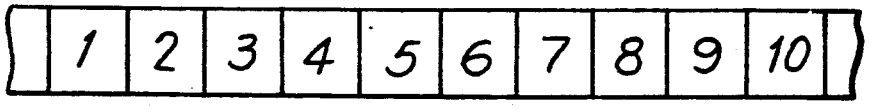
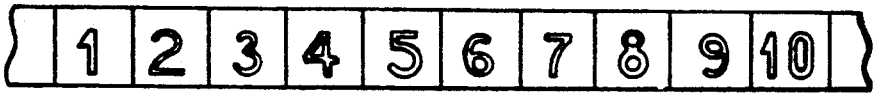
FIG. 18(b)

FIG. 17(a)
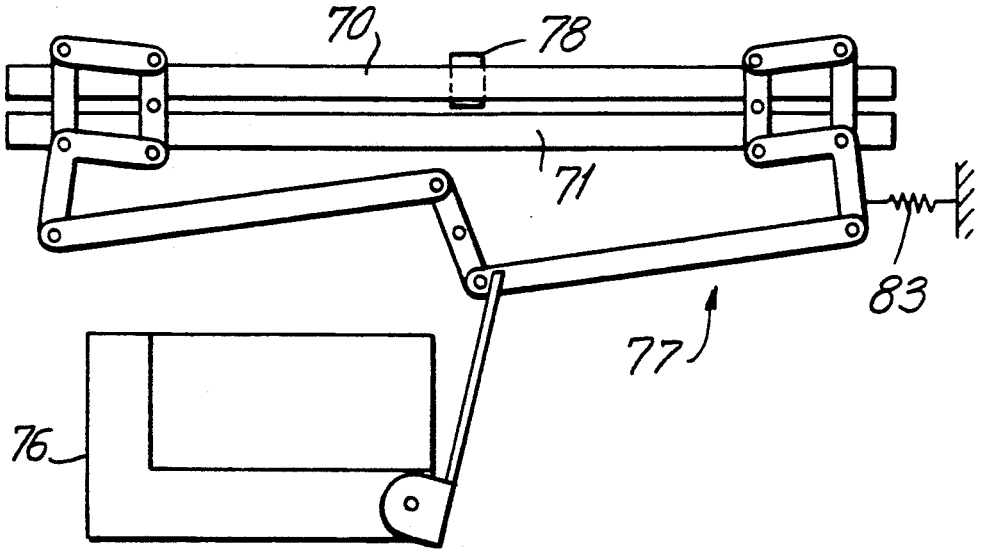
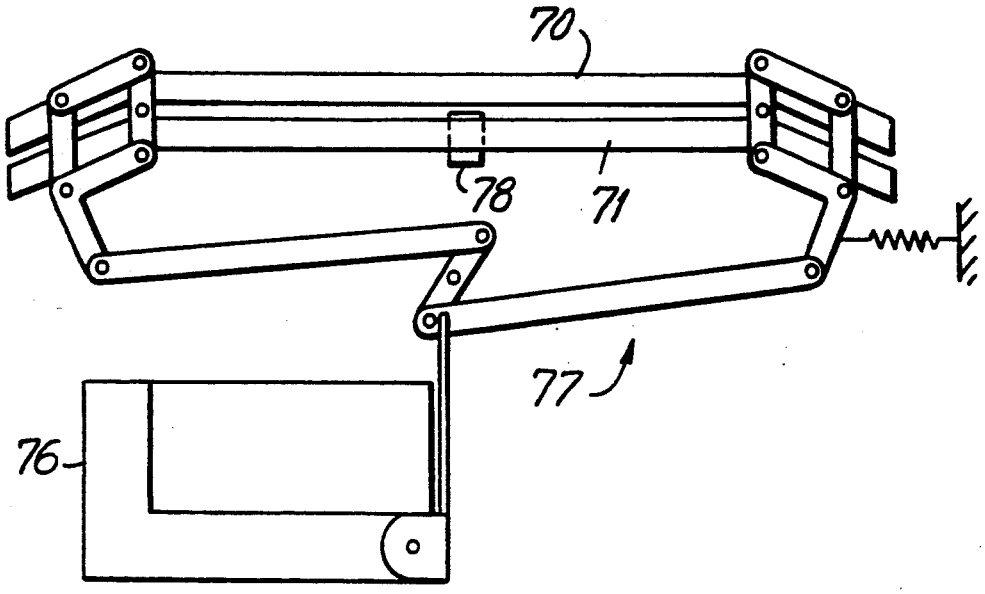
FIG. 17(b)

MINIATURE PRINTER

BACKGROUND OF THE INVENTION

The present invention relates to a miniature printer and more particularly to a miniature type printer. Type wheel printers used in miniature electronic devices are required to be small in size. As a consequence, the fonts which can be included on a type wheel are limited. In order to emphasize certain characters, some conventional printers possess a plurality of type wheels having ink pads for applying different color inks to the type wheels. The plurality of ink pads allow the printer to print characters in different colors in order to emphasize certain characters. This is disclosed in Japanese Patent Laid-Open Publication Nos. 56-137984 and 57-100089. The prior art was effective in emphasizing desired portions of a document by enabling the same characters to be printed in different colors.

However, there are several drawbacks associated with the prior art. First, the quality of the print tends to be degraded due to the mixing of different color inks. In addition, a complicated mechanism is required so that the ink roller of each color can correspond to the character to be printed. Furthermore, the cost of the ink rollers increases due to the necessity of utilizing special ink rollers which preclude the mixing of different color inks. Finally, the number of fonts is limited by the number of colors.

SUMMARY OF THE INVENTION

Generally speaking in accordance with the present invention, a miniature printer is provided. The printing apparatus can print characters in a larger number of character sets by combining the character sets actually provided in the printer and by utilizing only one color of ink. Different character sets having different fonts are arranged in columns and any one of these different fonts or character sets can be used or combined with one another to permit the emphasis of certain characters without the use of different color inks. The miniature printer may include a plurality of type columns each having types of the same characters that have different designs, means for selecting a type of a desired design and bringing the selected type to a position where it faces a printing region, and means for impacting the selected type against a recording paper. The type columns may be arranged on the outer periphery of cylindrical drum which is rotatable and axially displaceable for the positioning of the selected type in registration with the imprinting means. Every other location circumferentially and axially along the drum may be blank, the impacting means being two rows wide in the axial direction of the cylinder.

The type columns may also be arranged on belts which contains one or more character sets. The belts rotate in the direction of the width of the recording paper. A shifting mechanism displaces the belts for positioning the selected type in registration with the imprinting means.

Each character of a first design may be of a size greater than that of the same character of a second design and may include a white blank portion of a configuration related to that of the character of the first design.

Accordingly it is an object of the invention to provide an improved miniature printer which provides an ability to provide emphasized representations at a low cost.

It is another object of the invention to provide an improved miniature printer which can generate a plurality of print fonts greater than the number of fonts actually present in the printer.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5(*b*) is an illustration of a character of a second character set;

FIG. 5(*c*) is an illustration of characters formed by the printer with a character of the first and second character sets of FIGS. 5(*a*) and 5(*b*) superimposed on one another;

FIG. 11(*b*) is an illustration of a character of a second character set in accordance with a second embodiment;

FIG. 11(*c*) is an illustration of characters formed by the printer with characters of the first and second character sets of FIGS. 11(*a*) and 11(*b*) superimposed on each other;

FIG. 12(*b*) is a character of a second character set in accordance with a third embodiment of the present invention;

FIG. 12(*c*) is an illustration of a character formed by printing with the characters of FIGS. 12(*a*) and 12(*b*) superimposed over one another;

FIGS. 14(*a*) and 14(*b*) are illustrations of type belts of a first and second character set in accordance with further embodiments of the present invention;

FIG. 17(*a*) is a side elevational view of the type belt shift mechanism when the first type belt is selected;

FIG. 17(*b*) is a side elevational view of the type belt shift mechanism when the second type belt is selected; and FIGS. 18(*a*) and 18(*b*) are character sets used in the printing apparatus shown in FIG. 14.

DESCRIPTION OF THE PREFERRED EMBODIMENTS

Figure 1:
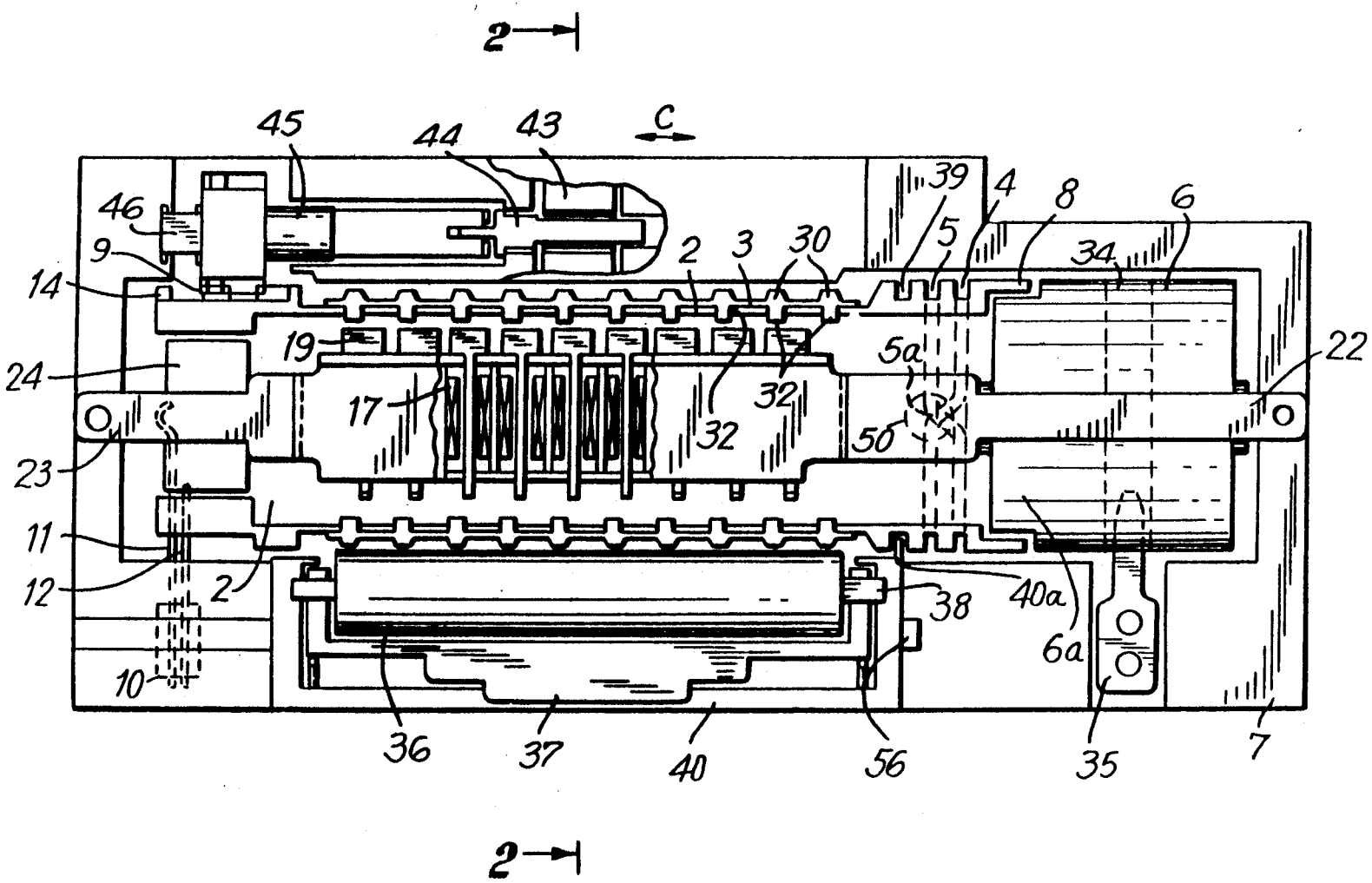
FIG. 1 is a top plan view, with portions broken away, of the compact printer of the present invention.
Figure 2:
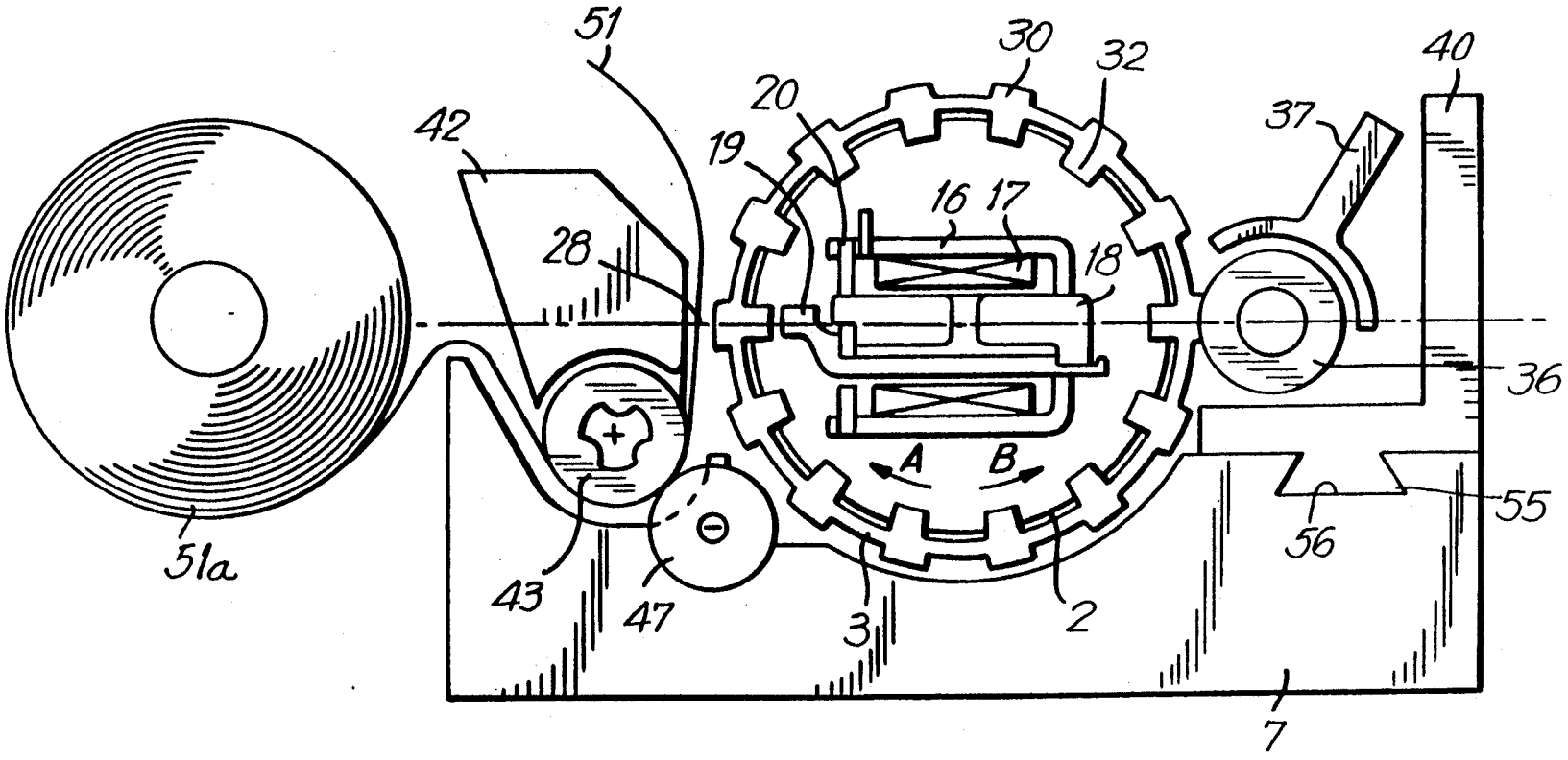
FIG. 2 is a cross-sectional view, along the lines 2—2 of FIG. 1.
Figure 3:
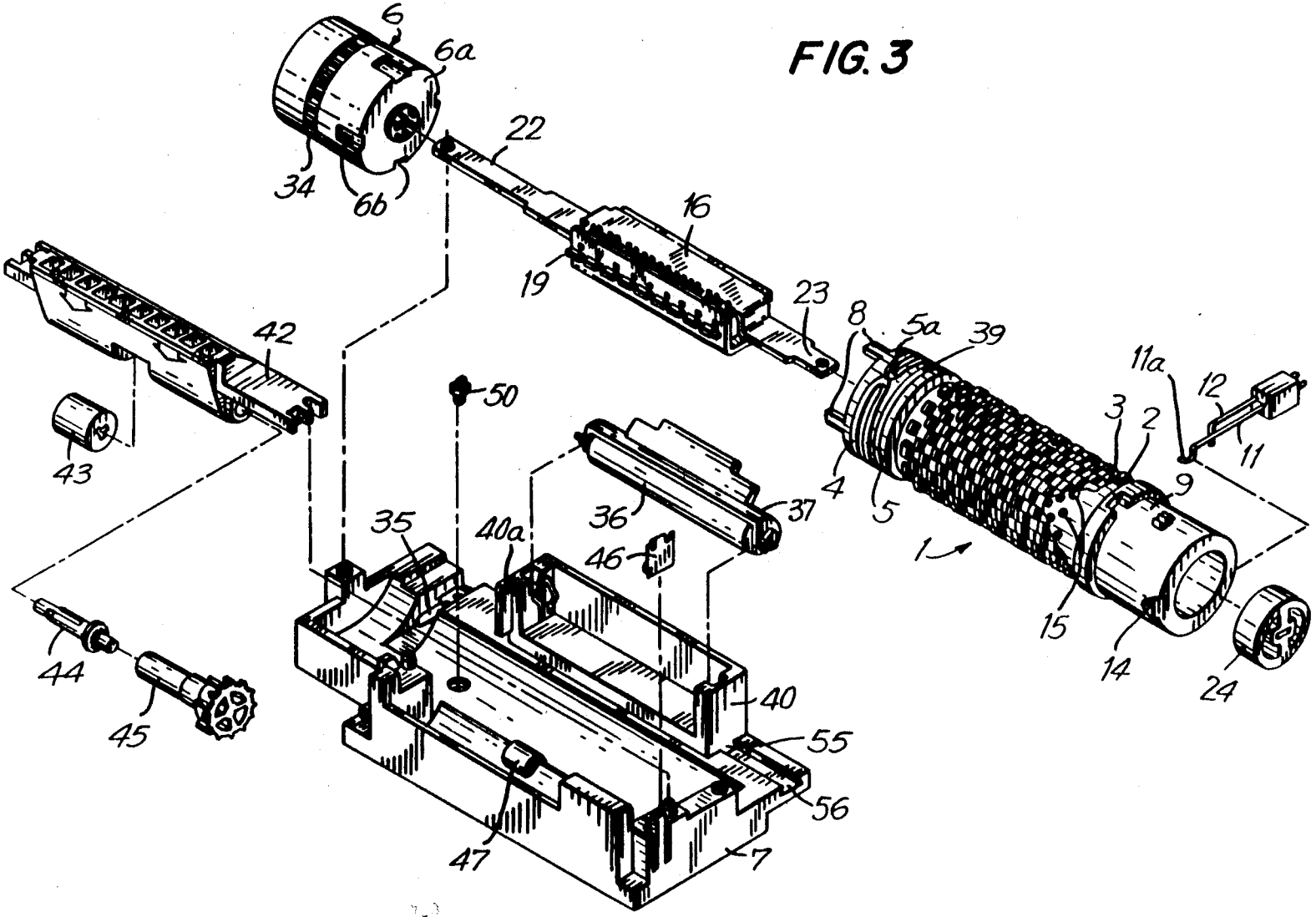
FIG. 3 is an exploded perspective view of the compact printer of FIGS. 1 and 2.

Referring to FIGS. 1, 2 and 3 showing a first embodiment of the present invention, a type drum 1 includes a cylinder 2 as a carrier member and a type sheet 3 provided on the surface of cylinder 2. Grooves 4 and 5, which are provided on one end of cylinder 2, are essentially parallel to each other except where they cross each other at 5*a*. These grooves are adapted to effect an axial shift by an amount corresponding to one column of type when cylinder 2 makes one full rotation. Projections 8 are provided on an end of cylinder 2 so as to be received in grooves 6*b* formed in a rotor 6*a* of a pulse motor 6 which is fixed to a base 7. A paper feed drive gear 9, which is fixed to the other end of cylinder 2, engages with a paper feed gear 45. A rotation detector 10 is associated with this end of cylinder 2 so as to detect rotation of cylinder 2. Rotation detector 10 includes a first detection spring 11 and a second detection spring 12. When type drum 1 rotates in the axial position corresponding to the lower place characters or lower column position (displaced to the right as viewed and shown in FIG. 1), a curved portion 11*a* of first detecting spring 11 rides on a reset signal cam 14 of type drum 1 so as to be forced to contact second detection spring 12, generating a reset signal.

Cylinder 2 is provided with a plurality of throughholes 15, which are formed in a portion of cylinder 2 where type sheet 3 is to be attached and which are adapted to receive projections 21 formed on type sheet 3. A hammer unit 16 is provided inside cylinder 2.

Hammer unit 16 includes a plurality of solenoid actuator units 20 which are arranged in the axial direction to correspond to the number of characters to be printed. Each solenoid actuator unit 20 includes a solenoid 17, a movable iron core (e.g. a plunger) 18 actuated by solenoid 17 and a hammer 19 connected to the end of iron core 18 so as to be able to engage with projections 21 of two columns of characters.

Hammer unit 16 is provided on both ends with mounting tabs 22 and 23. Mounting tab 22 extends through pulse motor 6 while mounting tab 23 is fixed to base 7 while being rotatably supported by type drum 1 through a bearing 24.

When a driving current is applied to one of solenoids 17, iron core 18 is attracted to solenoid 17 so that hammer 19 strokes a projection 21 on type sheet 3. The character corresponding to the struck projection 21 is impacted on a recording medium, for example paper 51 from roll 51*a* as shown in FIG. 2.

Figure 4:
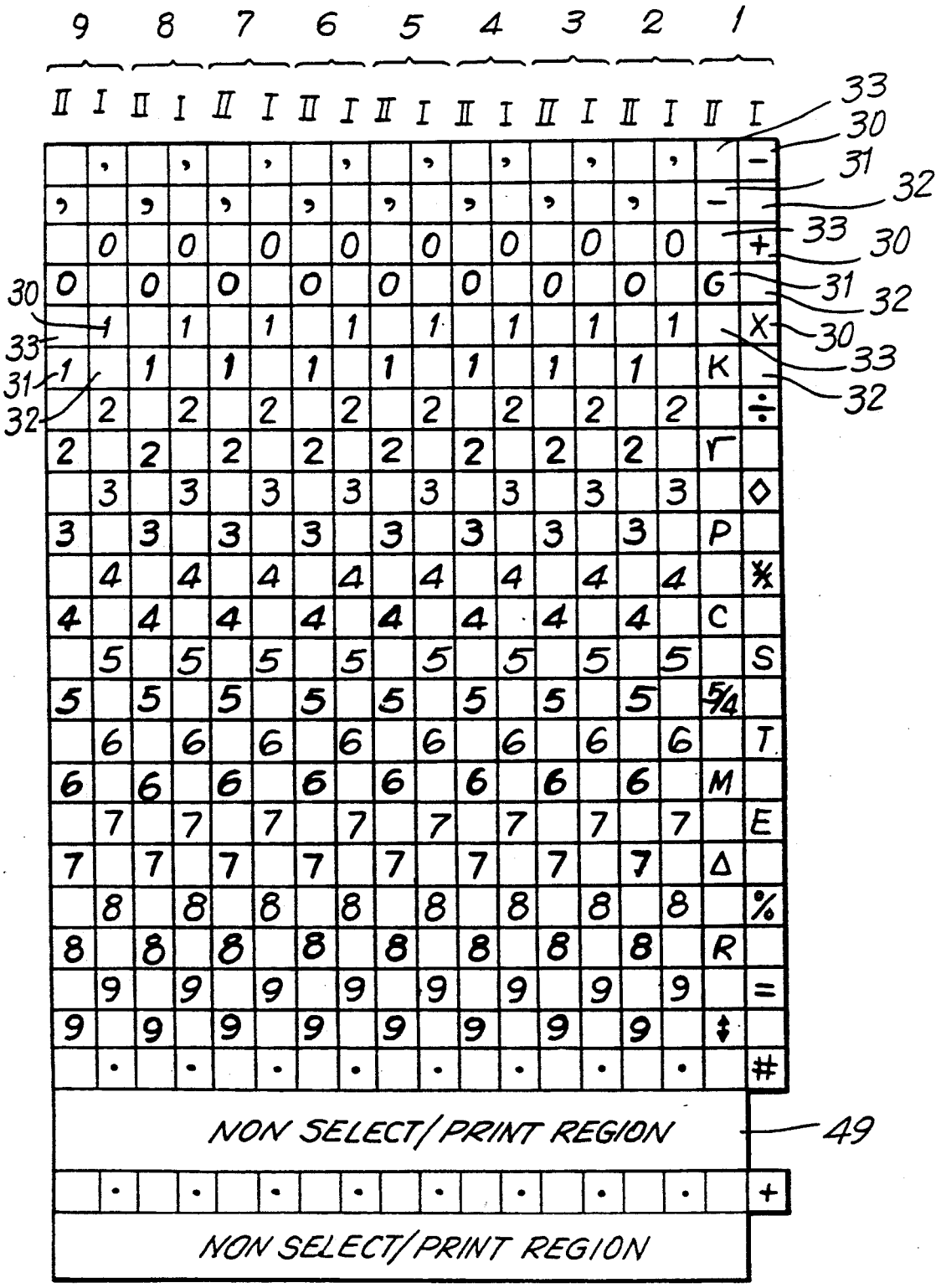
FIG. 4 is a developed view of the type sheet incorporated in the miniature printer of FIG. 1.

FIG. 4 shows the character sets of type sheet 3. Type sheet 3 is made of an elastic material such as rubber. It can be seen in FIGS. 8 and 9 that different hammers have their own column pairs (1), (2), (3), . . . , and each column pair consists of two columns, I and II, of characters. The hammers are in the position illustrated in FIG. 8 when the first character set is selected and the hammers are in the position illustrated in FIG. 9 when the second character set is selected. It should be noted that type drum 1 is axially displaced in the direction of arrow C (FIG. 1) between the positions of FIGS. 8 and 9. Columns I and II alternate across the print type sheet. Each column pair includes character sets 30 and 31. In each column, character sets 30 or 31 are arranged at a constant pitch in the circumferential direction (vertical direction as viewed in FIG. 4). Spacers 32 and 33 are placed between adjacent characters. In the first column, I, of the pair (1), character set 30 and spacers 32 are alternate in the circumferential direction. Similarly, in the second column, II, characters in character set 31 and spacers 33 are arranged a similar manner. Furthermore, in each column pair the characters of the first and second rows, I and II, are arranged in a staggered manner such that each character of one column is adjacent to a spacer in the other column of the column pair.

Figure 5A:
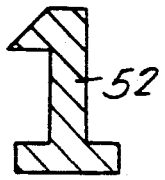
FIG. 5(*a*) is an illustration of a character of a first character set.
Figure 5B:
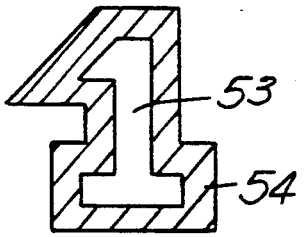
Figure 5C:
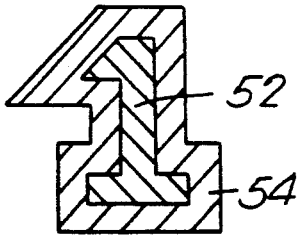

Each hammer will be identified in terms of the number of its column pair. Thus, for example, the hammer which covers pair (1) will be expressed as hammer (1). The fonts of the character sets are described below. Column pair 1 contains a set of unique symbols which are different in each column and which do not require emphasis in accordance with the invention. In case of the pairs (2) through (9) covered by hammers (2) through (9), the column corresponding to the lower place or lower column (the right side as viewed in FIG. 4) of printing, column I, contains characters 52 of a character set 30 with comparatively thin lines as shown in FIG. 5(*a*), whereas the column corresponding to the higher position (left side as viewed in the figure), column II, contains characters in which the interior 53 of the character 54 is blank and the background or outer outline 54 of the character defines character set 31. Characters sets 31 of column pairs (2) through (9) correspond to the profiles of the characters in the lower position, column I. An example of this character set is illustrated in FIG. 5(*b*). A non-print region 49 where type is not provided is included in the region opposite groove switching portion 5*a* for axially shifting the type drum 1 in the direction of arrow C of FIG. 1 between the upper place position and the lower place position Referring again to FIGS. 1, 2 and 3, pulse motor 6 is an outer-rotor motor with an exposed rotor. Ratchet teeth 34 are formed on the surface of rotor 6*a* at positions corresponding to the positions of the characters on type drum 1. Ratchet teeth 34 are adapted to engage with a ratchet pawl 35 provided on frame 7 in order to stop type drum 1 at printing position 28 (FIG. 2) in a clicking manner.

Ink roller 36 is covered by a frame 37 except at the portion facing the characters. Ink roller 36 is carried by a shaft 38 which is rotatable on an ink roll frame 40. Ink roll frame 40 is mounted on frame 7 in order to shift in the axial direction. Specifically, ink roll frame 40 is provided with a longitudinally extending projection 55 of trapezoidal cross-section which rides in a groove 56 of similar cross-section in frame 7. Ink roll frame 40 has a projection 40*a* engaging with a groove 39 formed in type drum 1, so that ink roll frame 40 can shift with type drum 1.

A platen 42 is attached to frame 7 and includes a paper feed roller 43 which is attached for rotation to platen 42. A paper feed shaft 44, which is journaled at its front end through platen 42, engages with paper feed roller 43 for driving same. Paper feed gear 45 is forced by a spring 46, provided on base 7, such that its front end contacts the rear end of paper feed shaft 44. Paper feed shaft 44 and paper feed gear 45 form a one-way clutch. A paper pressing roller 47, which is freely rotatably mounted on base 7, is forced to contact paper feed roller 43 so that paper feed roller 43 and paper pressing roller 47 cooperate with each other in feeding the recording paper 51.

A type drum shift member 50 is rotatably secured at its lower end to base 7 and has an upper portion with a ship-like stream-lined cross-section. This upper portion makes a sliding engagement with at least one of grooves 4 and 5 to slide along groove 4 or 5 in accordance with the rotation of type drum 1 and moves from one to the other of grooves 4 and 5 at crossing portion 5*a* of grooves 4 and 5.

Figure 6:
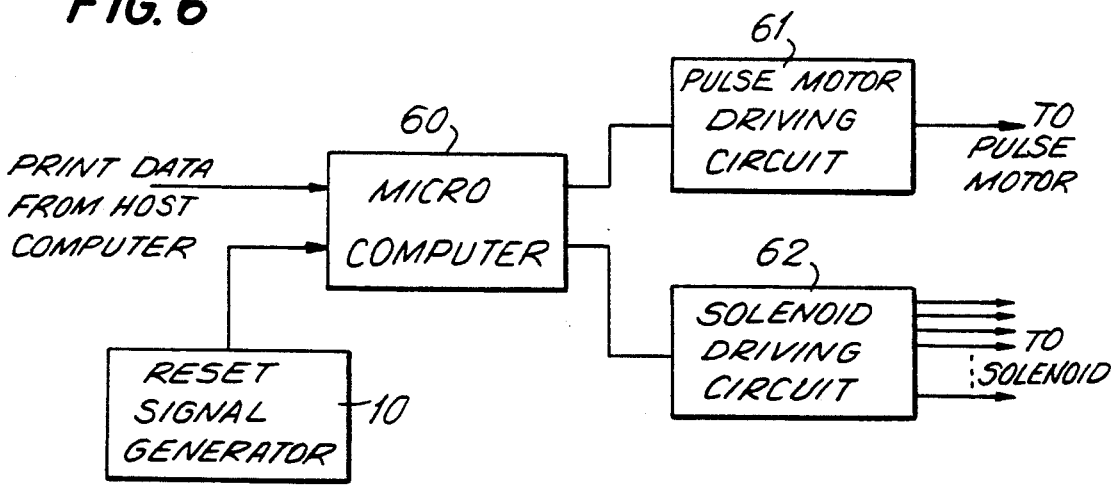
FIG. 6 is a block diagram of a controller for controlling and driving the pulse motor and solenoids which form the printing mechanism of FIG. 4.

FIG. 6 shows an example of a controller for controlling the operation of the printing apparatus. A microcomputer 60 receives a reset signal from a reset signal generator 10 and also receives printing data from a host device such as a measuring instrument or desktop calculator, through an interface (not shown). Microcomputer 60 also inputs, through an interface, signals to a pulse motor drive circuit 61 and a solenoid drive circuit 62 to drive the printer and select the character fonts.

The operation of the described printing apparatus will be explained with specific reference to the timing chart of FIG. 7.

Figure 7:
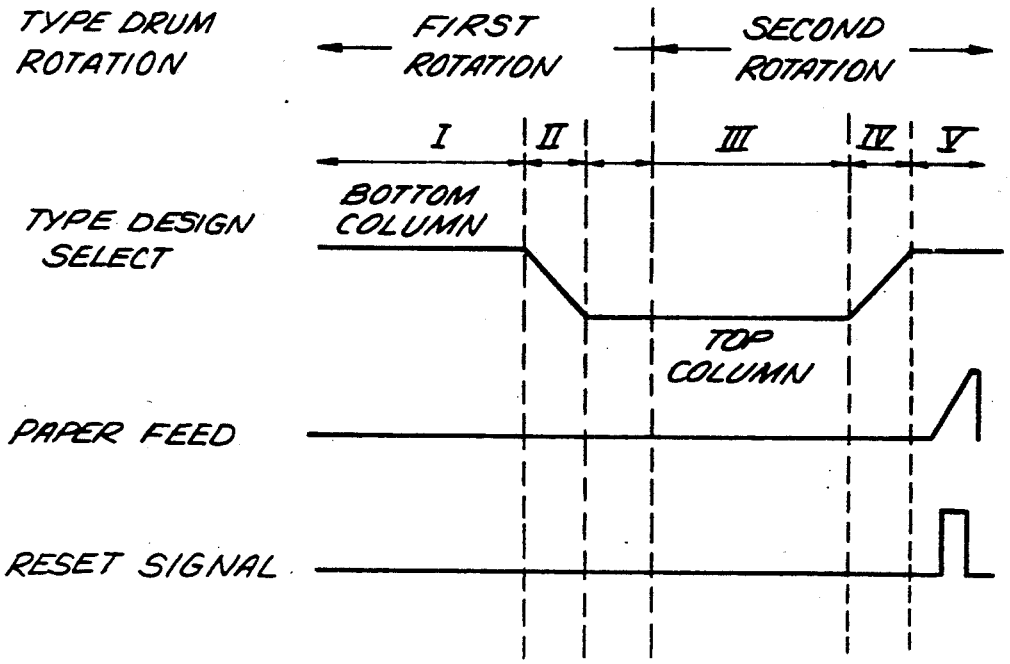
FIG. 7 is a timing chart of the operation of the controller.

Referring specifically to FIGS. 1, 3 and 7 in the initial period of printing, type drum shifting member 50 engages with groove 4 in type drum 1 so that type drum 1 is located at the position corresponding to the lower column I position of printing, i.e., the column position closer to pulse motor 6.

Figure 8:
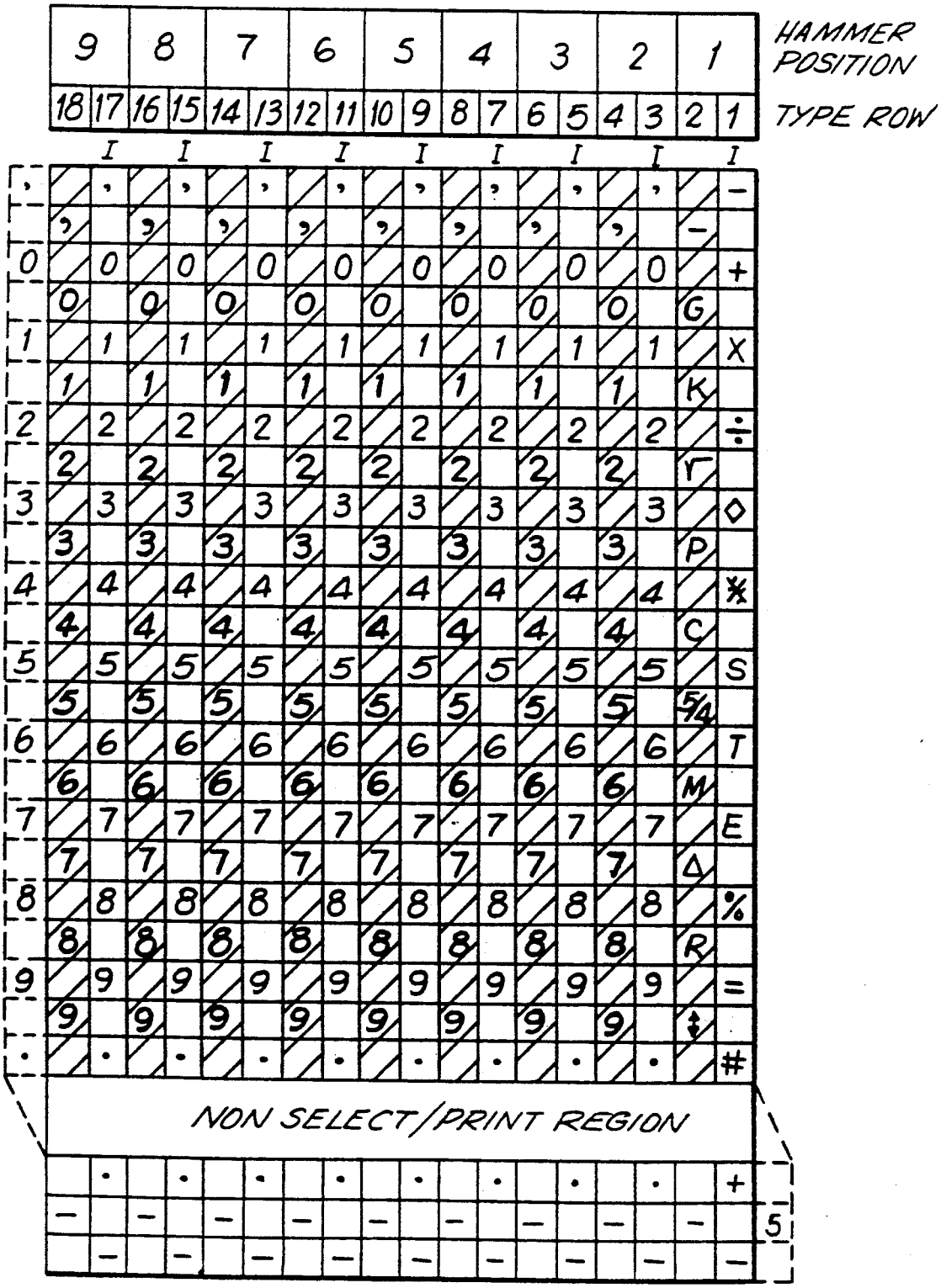
FIG. 8 shows the relationship between the type sheet and hammers when the characters of the first character set are selected.
Figure 9:
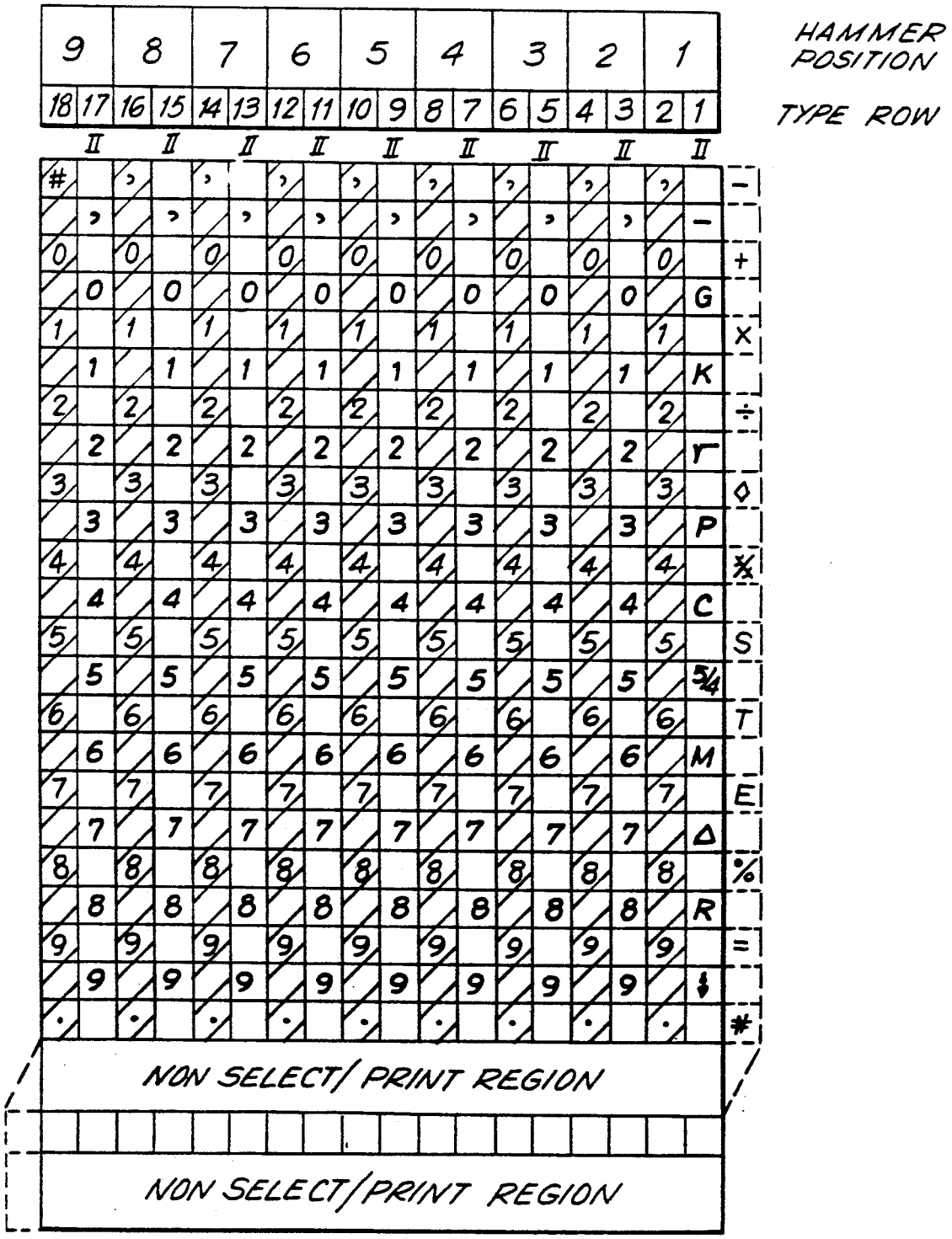
FIG. 9 shows the relationship between the type sheet and hammers when the characters of the second character set are selected.

Referring now to FIGS. 2, 7 and 8, the characters of columns I, are located in the printing positions of hammers (1)–(9) of hammer units 19. When pulse motor 6 operates in the direction of arrow A in accordance with an instruction from microcomputer 60, characters in character column I are successively brought to the printing position in front of each hammer pair, as a result of the rotation of type drum 1. When the character to be printed is brought to the position where it faces the printing position 28 (FIG. 2), pulse motor 6 is stopped and then reversed so as to operate in the direction of the arrow B. As a result, ratchet tooth 34 is stopped by pawl 35 in order to stop the reversing, whereby the character to be printed is located exactly at the printing position.

In this stage, microcomputer 60 operates to energize solenoid 17 corresponding to the hammer 16 opposite the character to be printed. The character to be printed opposes the printing surface so that hammer 16 of that particular column pair strikes the character, thereby printing the character of this font on the recording paper 51. Although hammer 16 impacts two character rows, only the character of column I is printed because a spacer faces the printing surface in column II. This operation occurs in period I of FIG. 7.

Referring again to FIGS. 3 and 6, microcomputer 60 directs pulse motor 6 to operate in the direction of the arrow A, when solenoid 17 is de-energized to finish the printing. This operation is repeated each time the desired character is brought to the position facing the recording paper. When type drum 1 has made almost one full rotation, all the characters on column I have passed the printing position facing the recording paper. It is therefore possible to print any desired character of the first font shown in FIG. 5(*a*).

Referring again to FIGS. 1 and 3, when type drum 1 has made almost one full rotation, type drum shift member 50 slides into groove 5 through crossing portion 5*a* of both grooves 4 and 5. As a consequence, type drum 1 is forced by type drum shift member 50 towards the upper column position for printing the other character set. This operation is conducted in period II of the flow chart in FIG. 7.

As a consequence, the characters of column II, i.e., the character of the second character set as shown in FIG. 5(*b*), are positioned in the printing position.

When the desired character is positioned to face the printing paper, microcomputer 60 operates to stop pulse motor 6 as in the previous step and then reverses the same to precisely locate this character at the printing position, followed by energization of solenoid 17. As a result, hammer 16 strikes projection 21 on the character, the character corresponding to the upper column position i.e., the character of the second character set as shown in FIG. 5(*b*), is printed. This operation is executed in period III in FIG. 7.

A character of the second character set is printed as shown in FIG. 5(*b*). However, if a character of the second character set, is printed on the same position where the a character of the first character set had previously been printed, the prints of the character of both designs are superposed on each other so that a character of a third character set, which is a combination of the first and second character sets, is printed, as shown in FIG. 5(*c*).

It is thus possible to obtain characters of the third character set although these characters are not actually present on the type cylinder.

Figure 10A:
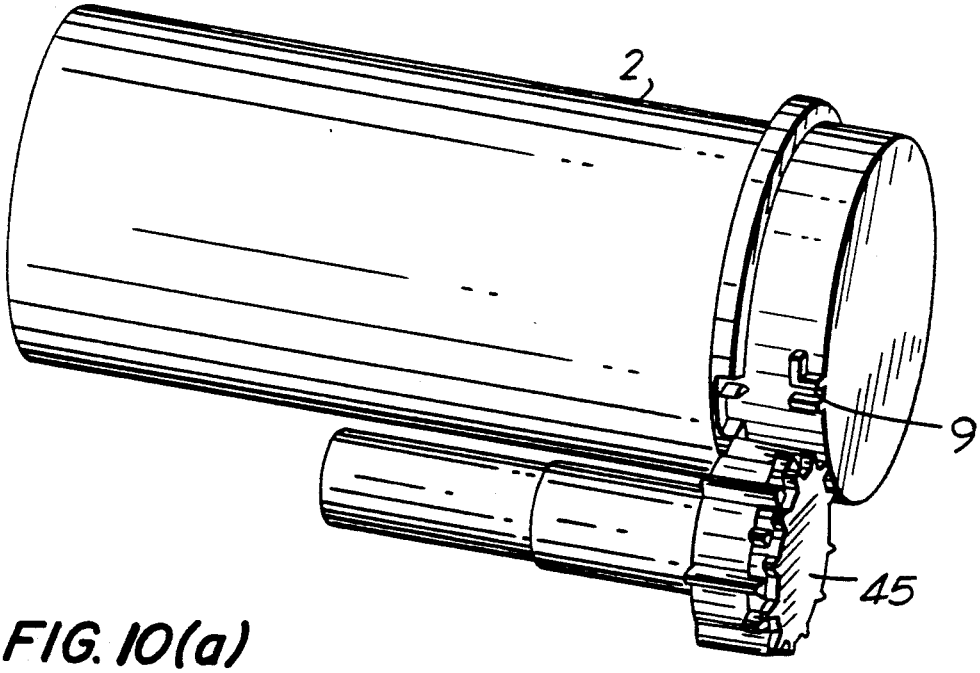
FIGS. 10(*a*) and 10(*b*) are perspective views showing the relative positions of the paper feed gear and paper feed drive gear at two positions of the type drum.
Figure 10B:
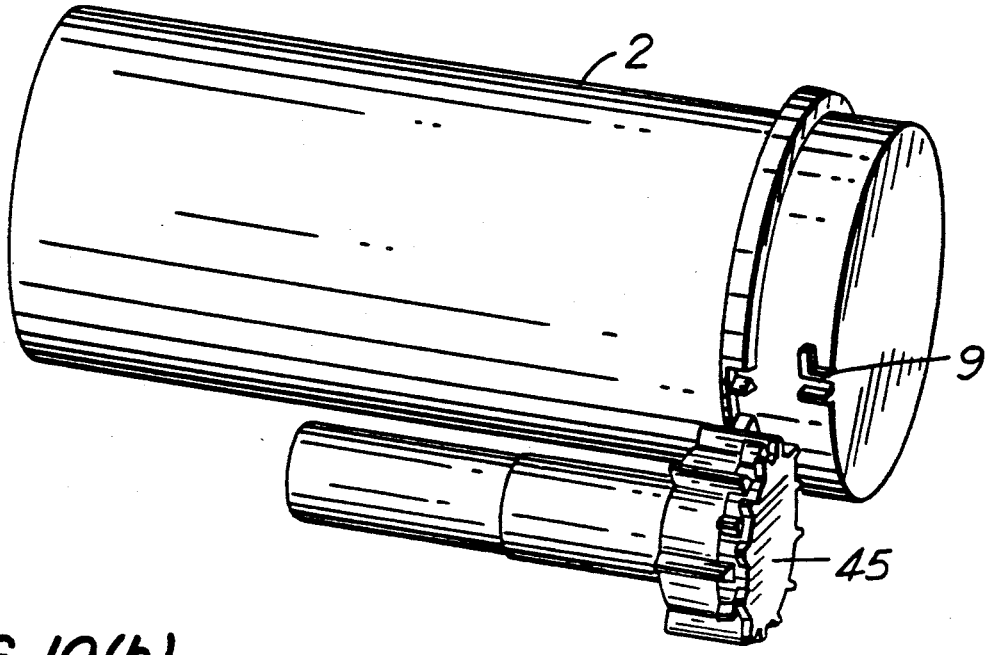

Referring now to FIGS. 10(*a*) and 10(*b*), the paper feeding step is explained. In the printing operation described above, type drum 1 rotates to a position where paper feed drive gear 9 on type drum 1 would engage with paper feed gear 45. In this case, however, since type drum 1 has been shifted axially to the upper column position (the right position as viewed in FIG. 1), paper feed gear 45 cannot engage with paper feed drive gear 9, as shown in FIG. 10(*b*), so that paper feed gear 45 is kept stationary regardless of the rotation of the type drum 1 and the print paper is not advanced to the next line.

Reset signal cam 14 of type drum 1 has also been rotated to an angular position where it could contact bent portion 11*a* of first detecting spring 11. In this case, however, reset signal cam 14 does not contact first detecting spring 11 because type drum 1 has been axially shifted to the position for printing characters in the upper column position so that no reset signal is generated.

When type drum 1 has made almost one full rotation after its axial shift to the position for printing in the upper column position, drum shift member 50 moves into groove 4 through crossing 5*a* between grooves 4 and 5. As a result, type drum 1 is forced towards the lower column position. This operation is performed in period IV as shown in FIG. 7.

As a result of the axial shift of type drum 1 to the lower column position, paper feed drive gear 9 can engage with paper feed gear 45 as shown in FIG. 10(*a*). Likewise, reset signal cam 14 can engage with first detecting spring 11.

A further rotation of type drum 1 causes paper feed drive gear 9 to engage with paper feed gear 45, as shown in FIG. 10(*b*), to enable the latter to feed the paper by an amount corresponding to one printing line. During this paper feeding operation, reset signal 14 engages with bent portion 11*a* of first detecting spring 11 to contact second detecting spring 12, thereby generating a reset signal in reset signal generator 10. This step is performed in period V of FIG. 7.

Upon receiving the reset signal, microcomputer 60 operates to stop pulse motor 6 when type drum 1 has been rotated to a predetermined position of rotation. The printing cycle for printing one line of data is thus completed. The described operation is repeated so that data can be printed in a plurality of lines.

In the described embodiment, two grooves 4 and 5 are formed in type drum 1 so as to be traced by shift member 50 provided on frame 7 thereby to shift type drum 1 between two axial positions. This, however, is not the exclusive method for shifting type drum 1. It will be clear to those skilled in the art that a similar effect is obtainable when the described shifting mechanism is replaced with a suitable mechanism such as a cam mechanism or a solenoid capable of effecting the shifting or reciprocatory motion of the type drum between two axial positions.

Second Embodiment

Figure 11A:
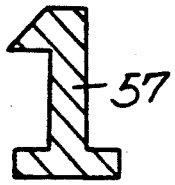
FIG. 11(*a*) is an illustration of a character of a first character set in accordance with a second embodiment.
Figure 11B:
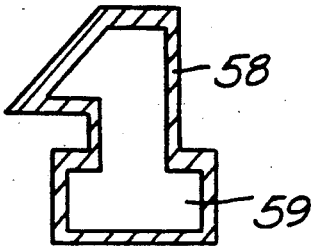
Figure 11C:
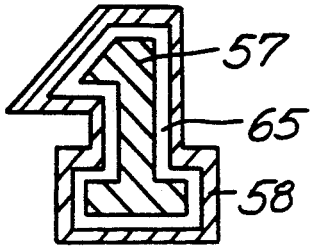

FIGS. 11(*a*)–11(*c*) show characters of another embodiment of the present invention in which characters of a first character set 30 are formed by comparatively thin lines 57 as shown in FIG. 11(*a*), while a character 58 in the second character set 31 has a blank center 59 corresponding to the character of the first character set although somewhat larger. This character is shown in FIG. 11(*b*). Thus, a character of a third font having a blank portion 65 as shown in FIG. 11(*b*) is obtained when the second character is superimposed on the first character.

Figure 12A:
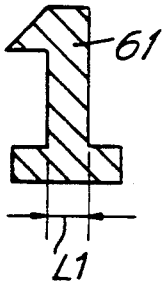
FIG. 12(*a*) is a character of a first character set in accordance with a third embodiment of the present invention.
Figure 12B:
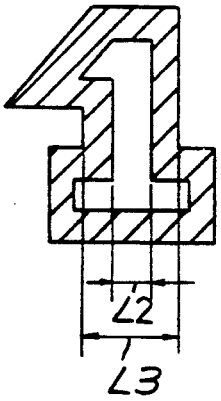
Figure 12C:
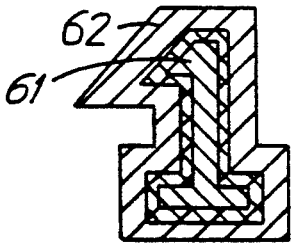
Figure 13A:
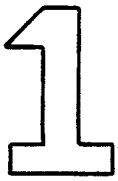
FIGS. 13(*a*) and 13(*b*) and FIGS. 13(*c*) and 13(*d*) illustrate pairs of characters which can be utilized in the alternative by the printer in accordance with the invention.
Figure 13B:
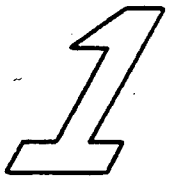
Figure 13C:
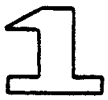
Figure 13D:
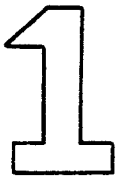

FIGS. 12(*a*)–12(*c*) show still another character set in which the characters 61 of the first character set 30 are composed of comparatively thin lines as shown in FIG. 12(*a*), while the characters 62 of the second character set 31 is of a design type having a central blank region 63 of the same configuration as the character in the first character set, yet slightly smaller. For instance, referring to FIGS. 12(*a*) and 12(*b*), the dimensions L1, L2 and L3 at the cross-sections taken along the chain lines must meet the condition: $L2<L1<L3$. When like characters of each character set are superimposed, the images of the printed character of both character, partially overlap each other, as shown in FIG. 12(*c*). This overlap allows for misregistration of printing and still ensure that the printed character has a completely darkened portion. More specifically, this embodiment provides a tolerance of error in the printing position up to $(L1-L2)/2$.

FIGS. 13(*a*) and 13 (*b*) and 13(*c*) and 13(*d*) respectively show examples of character set pairs or fonts which are different in inclination angle or size defining the first and second character sets.

In the embodiments described hereinbefore, the characters are arranged in columns such that the column of the characters of a first character set and the columns of characters of a second character set are offset from each other in the axial direction of the type drum. This, however, is only illustrative and the arrangement may be that shown in FIG. 14(*a*). Each column is divided into two regions 66 and 67 in the circumferential direction of the type drum and the characters of the first character set and the characters of the second character set are respectively provided in first and second circumferential regions. It is also possible to arrange the characters of each character set so that they appear alternately with one another in the circumferential direction as shown in FIG. 14(*b*). There are advantages in arranging the characters as in FIGS. 14(*a*) and 14(*b*). The printer mechanism can be simplified because it is not required to have a mechanism for effecting an axial shift of the type drum.

It will also be clear that the same advantages are obtained in a printer of the type in which a character impacts a recording paper through the intermediary of an ink ribbon, although in the described embodiment the printing is performed by transferring ink from a character which has been in contact with an ink-impregnated roll.

Third Embodiment

Figure 15:
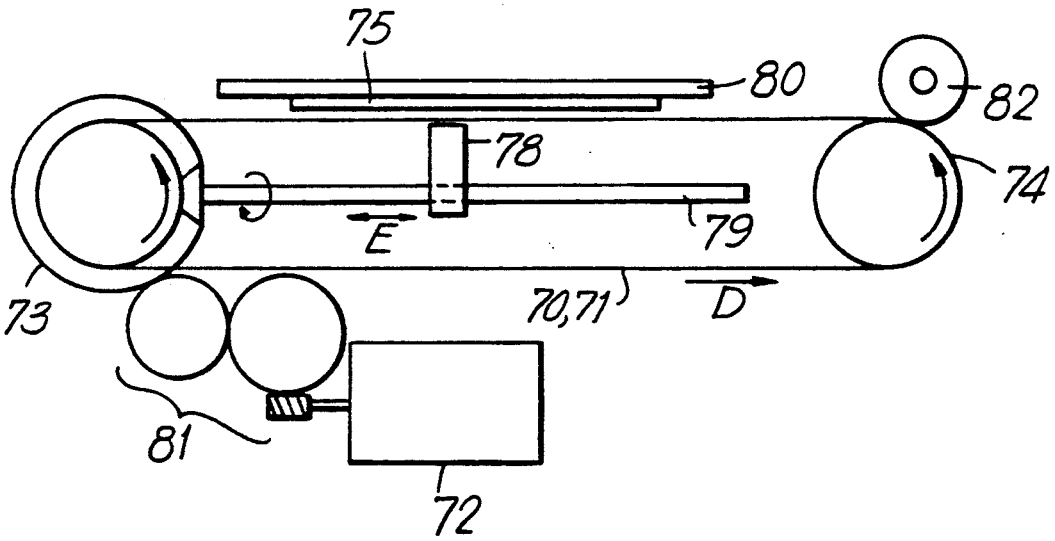
FIG. 15 is a side elevational view of another embodiment of the printing apparatus in accordance with the present invention suitable for using the type belts of FIGS. 14(*a*) and 14(*b*)
Figure 16:
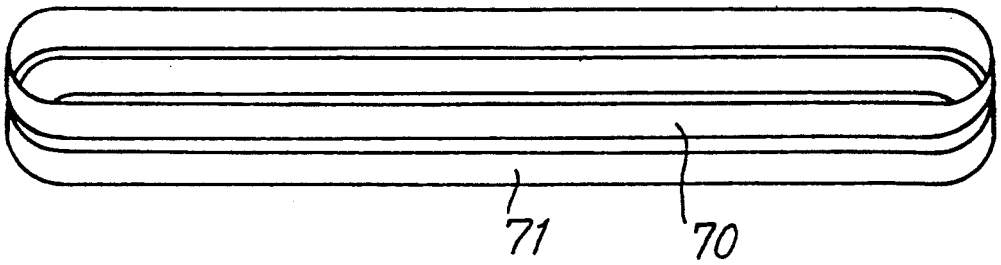
FIG. 16 is a perspective view of a pair of type belts used in the embodiment shown in FIG. 14.

Reference is now had to FIGS. 15 and 16 which illustrate a third embodiment. Type belts 70 and 71 are stretched between a drive pulley 73 driven by a pulse motor 72 through a gear train 81 and an idle pulley 74 so as to form upper and lower stages as shown in FIG. 16 and so as to extend substantially in parallel with the width of a recording paper 75. As pulse motor 72 operates, type belts 70 and 71 run in the direction of arrow D in FIG. 15. As will be seen from FIGS. 17(*a*) and 17(*b*), type belts 70 and 71 are coupled, on opposite side of paper 75, on a type belt sliding mechanism 77 which includes a link mechanism to be actuated by a solenoid 76. A hammer 78 presses characters on one of type belts 70 and 71 onto recording paper 75 against a platen 80. The type fonts on type belts 70 and 71 are inked by an ink roller 82. Hammer 78 is arranged substantially in parallel with the printing line so as to be moved in the direction of the width of the recording paper a denoted by an arrow E, by operation of a guide member 79 which is rotatably driven by drive pulley 73 through meshing gears.

Type belt 70 carries characters of a first character set as shown in FIG. 18(*a*) while type belt 71 carries characters of a second character set shown in FIG. 18(*b*).

Type belts 70, 71 rotate in the direction of width of the recording paper 75 so that the characters on type belts 70, 71 scan the recording paper in a horizontal direction. In this state, since solenoid 76 is not energized, type belts 70 and 71 run such that the characters on first belt 70, indicated in FIG. 18(*a*) face the recording paper. Spring 83 biases type belt sliding mechanism 77 to this position.

As hammer 78 is activated in this state, hammer 78 strikes the character against recording paper 75, whereby the character of the first character set is printed.

When solenoid 76 is activated, it causes type belt sliding mechanism 77 to lift type belts 70 and 71 as shown in FIG. 16(*b*), so that type belt 71 is brought into position where it faces the printing line. Activation of hammer 78 in this state causes a character of the second character set, as shown in FIG. 18(*b*), on type belt 71 to impact recording paper 75. As seen in previous embodiments a character of a first character set can be combined with a character of a second character set by superimposing the characters. The resulting third character is part of a new third character set or font.

In the third embodiment described in FIGS. 15, 16 and 17(*a*), 17(*b*), the character of the first and second character sets are provided on different belts. This, however, is not essential and the arrangement may be such that characters of many character sets are formed in different regions on a single belt, as illustrated in the modifications to the preceding embodiment shown in FIGS. 14(*a*) and 14(*b*). In such a case, there is no necessity for a mechanism to effect vertical shift of the type belts and this enables a simplified construction of the printing apparatus.

As will be fully understood from the foregoing description, the present invention provides: a printing apparatus comprising a plurality of columns having characters with varying fonts, and a mechanism for selecting a character in a desired character set and bringing the selected characters to a position where it faces a printing region. Also provided is a mechanism for impacting the selected character against a printing paper. It is therefore possible to obtain a plurality of print fonts greater in number than the number of fonts actually present in the printer. Furthermore, since the necessity for the use of different color inks is eliminated, it is possible to simplify the construction of the apparatus through simplification of the ink supplying mechanism, while avoiding degradation of the printing quality caused by the mixing of different color inks.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A miniature printer, comprising:

a plurality of type rows including at least a first and a second print type group, the first and second print type groups each defining the same characters to be printed but of different designs;

selecting means for selecting a type of a desired design and character from said plurality of type rows and bringing the selected type to a printing position; said selecting means selectively and sequentially positioning corresponding characters from each of said first and second print type groups in a single printing position to effect selective overlapping printing of two characters of different designs respectively from said first and second print type groups, whereby a different design representative of the overlapping characters is created by said first and second print type groups; and means for impacting the selected type to effect printing at a printing position.

2. The miniature printer of claim 1, wherein said type rows are arranged on the outer periphery of a cylindrical drum.

3. The miniature printer of claim 2, wherein said type selecting means includes means for rotatably and axially displacing said drum.

4. The miniature printer of claim 2, wherein said selecting means is adapted to selectively and sequentially position corresponding characters from each of said first and second print type groups in a single printing position to effect selective overlapping printing of two characters of different designs, whereby a different design representative of the characters is created by said first and second print type groups;

each character of the first print group having a size greater than that of the same character of a second print group and includes a blank portion in a central region thereof at least in part in registration with at least a portion of the corresponding character of the second print type group.

5. The miniature printer of claim 4, wherein the blank portion of the characters of the first print type group is of a configuration corresponding to that of the same character of said first print type group.

6. The miniature printer of claim 5, wherein the blank portion of the characters of said first print type group has essentially the same configuration as the corresponding character of said second print type group.

7. The miniature printer of claim 5, wherein the blank portion of the characters of said first print type group has a size greater than the corresponding character of said second print type group.

8. The miniature printer of claim 5, wherein the blank portion of the characters of said first print type group has a size greater than that of the corresponding character of said second print type group, said corresponding character of said second print type group being positioned to be received within the blank portion of the corresponding character of said first print type group with a blank border therearound if printed in registration with said corresponding character of said first print type group.

9. The miniature printer of claim 5, wherein said selecting means is adapted to selectively and sequentially position corresponding characters from each of said first and second print type groups in a single printing position to effect selective overlapping printing of two characters of different designs, whereby three different designs representative of the character are created by said first and second print type groups.

10. The miniature printer of claim 1, wherein said selecting means is adapted to selectively and sequentially position corresponding characters from each of said first and second print type groups in a single printing position to effect selective overlapping printing of two characters of different designs, whereby three different designs representative of the character are created by said first and second print type groups.

11. The miniature printer of claim 1, wherein said selecting means is adapted to selectively and sequentially position corresponding characters from each of said first and second print type groups in a single printing position to effect selective overlapping printing of two characters of different designs, whereby a different design representative of the characters is created by said first and second print type groups;

each character of the first print group having a size greater than that of the same character of a second print group and includes a blank portion in a central region thereof at least in part in registration with at least a portion of the corresponding character of the second print type group.

12. The miniature printer of claim 11, when the blank portion of the characters of the first print type group is of a configuration corresponding to that of the same character of said first print type group.

13. The miniature printer of claim 12, wherein the blank portion of the characters of said first print type group has essentially the same configuration as the corresponding character of said second print type group.

14. The miniature printer of claim 12, wherein the blank portion of the characters of said first print type group has a size greater than the corresponding character of said second print type group.

15. The miniature printer of claim 12, wherein the blank portion of the characters of said first print type group has a size greater than that of the corresponding character of said second print type group, said corresponding character of said second print type group being positioned to be received within the blank portion of the corresponding character of said first print type group with a blank border therearound if printed in registration with said corresponding character of said first print type group.

16. The miniature printer of claim 11, wherein said selecting means is adapted to selectively and sequentially position corresponding characters from each of said first and second print type groups in a single printing position to effect selective overlapping printing of two characters of different designs, whereby three different designs representative of the character are created by said first and second print type groups.

17. The miniature printer of claim 1, wherein said first and second print type groups each include a row of said characters of the same design, a row of characters from said first print type group being positioned adjacent a row of corresponding characters from said second print type group.

18. The miniature printer as recited in claim 17, wherein the characters of each of said rows of characters of the same design are spaced apart and the adjacent rows are positioned such that each character on each row is adjacent a space between the characters on the adjacent row from the other of said first and second print type groups.

19. The miniature printer of claim 18, wherein said impacting means includes hammer means of a width sufficient to overlie two adjacent of said rows, one taken from each of said first and second print type groups.

20. The miniature printer of claim 2, wherein said first and second print type groups each include a row of said characters of the same design, a row of characters from said first print type group being positioned adjacent a row of corresponding characters from said second print type group.

21. The miniature printer as recited in claim 20, wherein the characters of each of said rows of characters of the same design are spaced apart and the adjacent rows are positioned such that each character on each row is adjacent a space between the characters on the adjacent row from the other of said first and second print type groups.

22. The miniature printer of claim 21, wherein said impacting means includes hammer means of a width sufficient to overlie two adjacent of said rows, one taken from each of said first and second print type groups.

23. The miniature printer of claim 1, wherein each of said type rows has corresponding characters of said different designs from said first and second print type groups.

24. The miniature printer of claim 2, wherein said impacting means includes hammer means of a width sufficient to overlie two adjacent of said rows, one taken from each of said first and second print type groups.

25. The miniature printer of claim 5, wherein the blank portion of the characters of said first print type group has a size smaller than that of said corresponding character of said second print type group, said corresponding character of said first print type group being positioned by said selecting means to encompass said blank portion and partially overlaps said corresponding character of said first print type group.

26. The miniature printer of claim 12, wherein the blank portion of the characters of said first print type group has a size smaller than that of said corresponding character of said second print type group, said corresponding character of said first print type group being positioned to encompass said blank portion and partially overlaps said corresponding character of said first print type group.

27. A miniature printer, comprising:

rotatable type drum means;

driving means for applying a driving force to said rotatable type drum means to rotate said rotatable type drum means about its axis;

at least first and second print type groups arranged in a predetermined pattern formed on said rotatable type drum means disposed in columns arranged along the circumference of said type drum means, each of said print type groups including at least one row of types defining characters, the types of the first and second print type groups defining at least in part the same characters, the characters of the first print type group being of a design different from that of the characters of the second print type group, a row of characters of said first print type group being aligned circumferentially in parallel to the corresponding group of characters of said second print type group;

type shifting means for shifting said rotatable type drum means axially from a first position to a second predetermined position to select one of said print type groups; and means internal to said type drum means for impacting a selected type rotatably and axially positioned at a printing position to effect printing.

28. The miniature printer of claim 27, wherein said type shifting means and driving means permit the selective functions of corresponding types representative of the same character from said first and second print type groups at the same printing position to generate a print type group not formed on said rotatable type drum means out of said first and second print type groups.

29. The miniature printer of claim 27, further including a frame and projection protruding from said frame, and wherein said rotatable type drum means includes a pair of grooves encircling said rotatable type drum means and a crossover groove therebetween, said projection positionable within each of said grooves, said projection and grooves serving as said type shifting means wherein said rotatable type drum means upon application of said driving force by said driving means moves said type drum means axially based on the position of said projection in said grooves.

30. The miniature printer of claim 27, further including at least one solenoid means and at least one hammer means housed within said rotatable type drum means, said at least one hammer means driven by said at least one solenoid means for striking a type positioned at said printing position from inside said rotatable type drum means.

31. The miniature printer of claim 27, wherein each character of the first print group has a size greater than that of the same character of a second print group and includes a blank portion in a central region thereof at least in part in registration with at least a portion of the corresponding character of the second print type group.

32. The miniature printer of claim 31, wherein the blank portion of the characters of the first print type group is of a configuration corresponding to that of the same character of said first print type group.

33. The miniature printer of claim 32, wherein the blank portion of the characters of said first print type group has essentially the same configuration as the corresponding character of said second print type group.

34. The miniature printer of claim 32, wherein the blank portion of the characters of said first print type group has a size greater than the corresponding character of said second print type group.

35. The miniature printer of claim 32, wherein the blank portion of the characters of said first print type group has a size greater than that of the corresponding character of said second print type group, said corresponding character of said second print type group being positioned to be received within the blank portion of the corresponding character of said first print type group with a blank border therearound if printed in registration with said corresponding character of said first print type group.

36. The miniature printer of claim 31, wherein said selecting means is adapted to selectively and sequentially position corresponding characters from each of said first and second print type groups in a single printing position to effect selective overlapping printing of two characters of different designs, whereby three different designs representative of the character are created by said first and second print type groups.

37. The miniature printer of claim 27, wherein said selecting means is adapted to selectively and sequentially position corresponding characters from each of said first and second print type groups in a single printing position to effect selective overlapping printing of two characters of different designs, whereby three different designs representative of the character are created by said first and second print type groups.

38. The miniature printer of claim 27, wherein said first and second print type groups each include a row of said characters of the same design, a row of characters from said first print type group being positioned adjacent a row of corresponding characters from said second print type group.

39. The miniature printer as recited in claim 38, wherein the characters of each of said rows of characters of the same design are spaced apart and the adjacent rows are positioned such that each character on each row is adjacent a space between the characters on the adjacent row from the other of said first and second print type groups.

40. The miniature printer of claim 39, wherein said impacting means includes hammer means of a width sufficient to overlie two adjacent of said rows, one taken from each of said first and second print type groups.

41. The miniature printer of claim 32, wherein the blank portion of the characters of said first print type group has a size smaller than that of said corresponding character of said second print type group, said corresponding character of said first print type group being positioned by said type shifting means to encompass said blank portion and partially overlaps said corresponding character of said first print type group.

* * * * *